United States Patent [19]

Marx

[11] Patent Number: 4,723,894

[45] Date of Patent: Feb. 9, 1988

[54] LOW-PRESSURE AIR PUMP

[75] Inventor: Howard B. Marx, Chagrin Falls, Ohio

[73] Assignee: Transamerica DeLaval, Inc., Princeton, N.J.

[21] Appl. No.: 937,217

[22] Filed: Dec. 3, 1986

[51] Int. Cl.[4] ..... F04B 1/18; F04B 45/02

[52] U.S. Cl. ..... 417/269; 417/473; 417/566

[58] Field of Search ..... 417/269, 473, 566

[56] References Cited

U.S. PATENT DOCUMENTS

| | | | |
|---|---|---|---|
| 862,867 | 8/1907 | Eggleston | 417/390 |
| 1,454,886 | 5/1923 | Giesler | 92/44 |
| 2,374,595 | 4/1945 | Franz | 417/269 |
| 2,534,153 | 12/1950 | Widmer | 417/269 |
| 2,809,868 | 10/1957 | Thompson | 417/473 |
| 2,856,955 | 10/1958 | Winkelman | 137/855 |
| 3,314,600 | 4/1967 | Hadley | 417/566 |
| 3,754,842 | 8/1973 | Schlanzky | 417/269 |
| 3,992,131 | 11/1976 | Masterman | 417/206 |
| 4,486,151 | 12/1984 | Rorhonen | 417/566 |
| 4,495,855 | 1/1985 | Murakami | 417/269 |

FOREIGN PATENT DOCUMENTS

| | | | |
|---|---|---|---|
| 2115644 | 10/1972 | Fed. Rep. of Germany | 417/566 |
| 2613992 | 10/1977 | Fed. Rep. of Germany | 417/269 |

*Primary Examiner*—William L. Freeh

*Attorney, Agent, or Firm*—Hopgood, Calimafde, Kalil, Blaustein & Judlowe

[57] ABSTRACT

A motor-driven continuously running system wherein multiple reciprocating bellows units are disposed in angularly spaced relation about the rotary axis of a swashplate. Each bellows is frame-referenced at one end, and its other end is axially driven by the swashplate. As the bellows units reciprocate in phased succession, air is driven into and expelled through a valve/-manifold unit, which channels air to and from outlet and inlet fittings, via integrally formed reed check valves. The output is a steady flow of contamination-free pressurized air.

11 Claims, 7 Drawing Figures

LOW-PRESSURE AIR PUMP

BACKGROUND OF THE INVENTION

The invention relates to air-pump structure that is particularly suited to serve certain auxiliary functions on an aircraft, such as the low-pressure loading of a limited supply system for potable water to serve the various lavatory and kitchen facilities of an aircraft.

Prior systems of the character indicated have relied on motor-driven reciprocating-piston pumps, which are inherently unbalanced and are a source of noise and wear, requiring relatively frequent maintenance, involving replacement of component parts as well as lubrication. In addition to noise and wear, these prior systems generate lubricant-laden dust, which coats the pump as well as the pump drive and any other adjacent structure, so that frequent cleaning is imperative. And of course, any lubricant needed for a piston-driven system is a source of at least some contamination of its delivered pressurized air.

BRIEF STATEMENT OF THE INVENTION

It is an object of the invention to provide an improved air pump of the character indicated, avoiding disadvantages of prior devices.

It is a specific object to meet the above object in a configuration which is sealed and requires minimum lubrication at very much reduced frequency, as compared with prior systems, and which produces an inherently uncontaminated output of pressurized air.

Another specific object is to avoid the use of a piston or pistons in such an air pump.

It is a general object to provide an air pump meeting the above objects in an essentially balanced mechanical system, at very much reduced noise level and inherently characterized by long and trouble-free continuous service capability.

The invention meets the foregoing objects in a motor-driven continuously running system wherein multiple reciprocating bellows units are disposed in angularly spaced relation about the rotary axis of a swashplate. Each bellows is frame-referenced at one end, and its other end is axially driven by the swashplate. As the bellows units reciprocate in phased succession, air is driven into and expelled through a valve/manifold unit, which channels air to and from outlet and inlet fittings, via integrally formed reed check valves. The output is a steady flow of contamination-free pressurized air.

DETAILED DESCRIPTION

A preferred embodiment of the invention will be described in detail, in conjunction with the accompanying drawings, in which.

Figure 1:
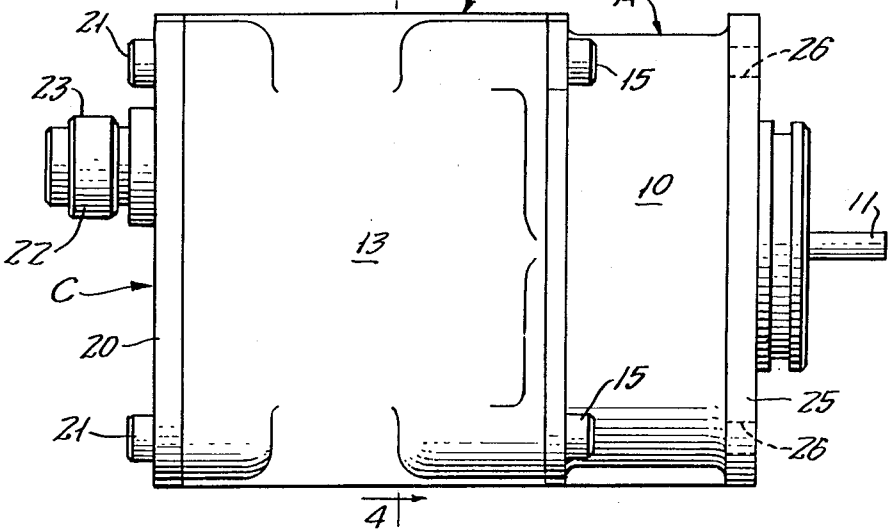
FIGS. 1 and 2 are views in side and end elevation, respectively, for an air-pump system of the invention.
Figure 3:
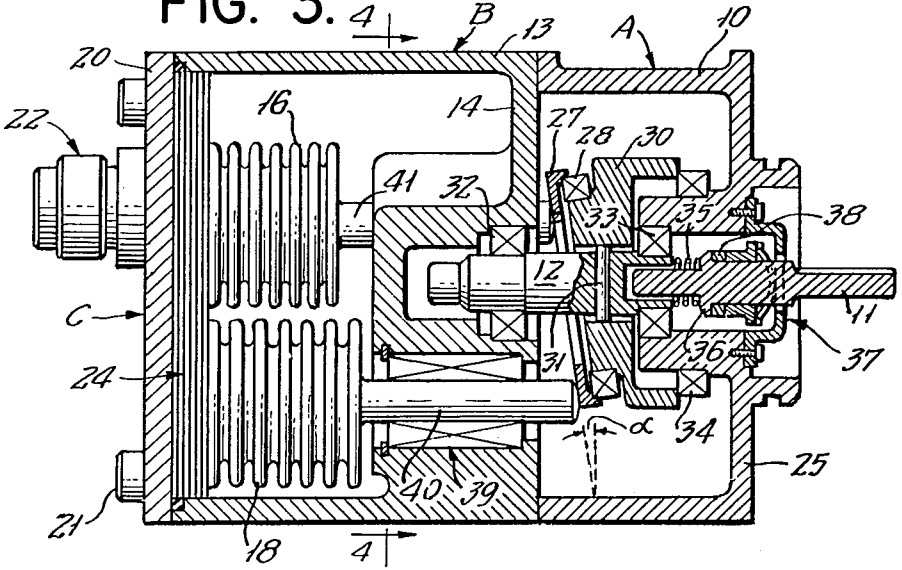
FIG. 3 is a view in longitudinal section, taken at 3—3 in FIG. 2.
Figure 2:
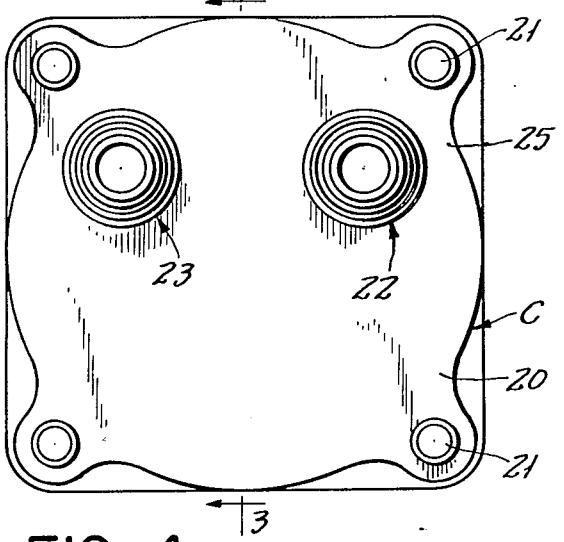
Figure 4:
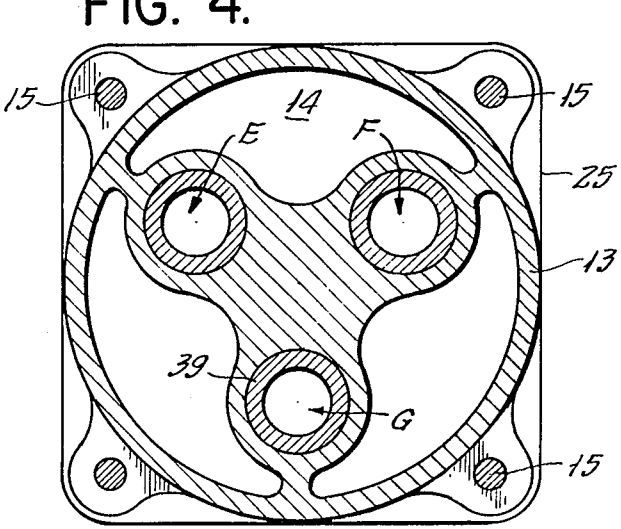
FIG. 4 is a view in transverse section, taken at 4—4 in FIGS. 1 and 3.
Figure 6:
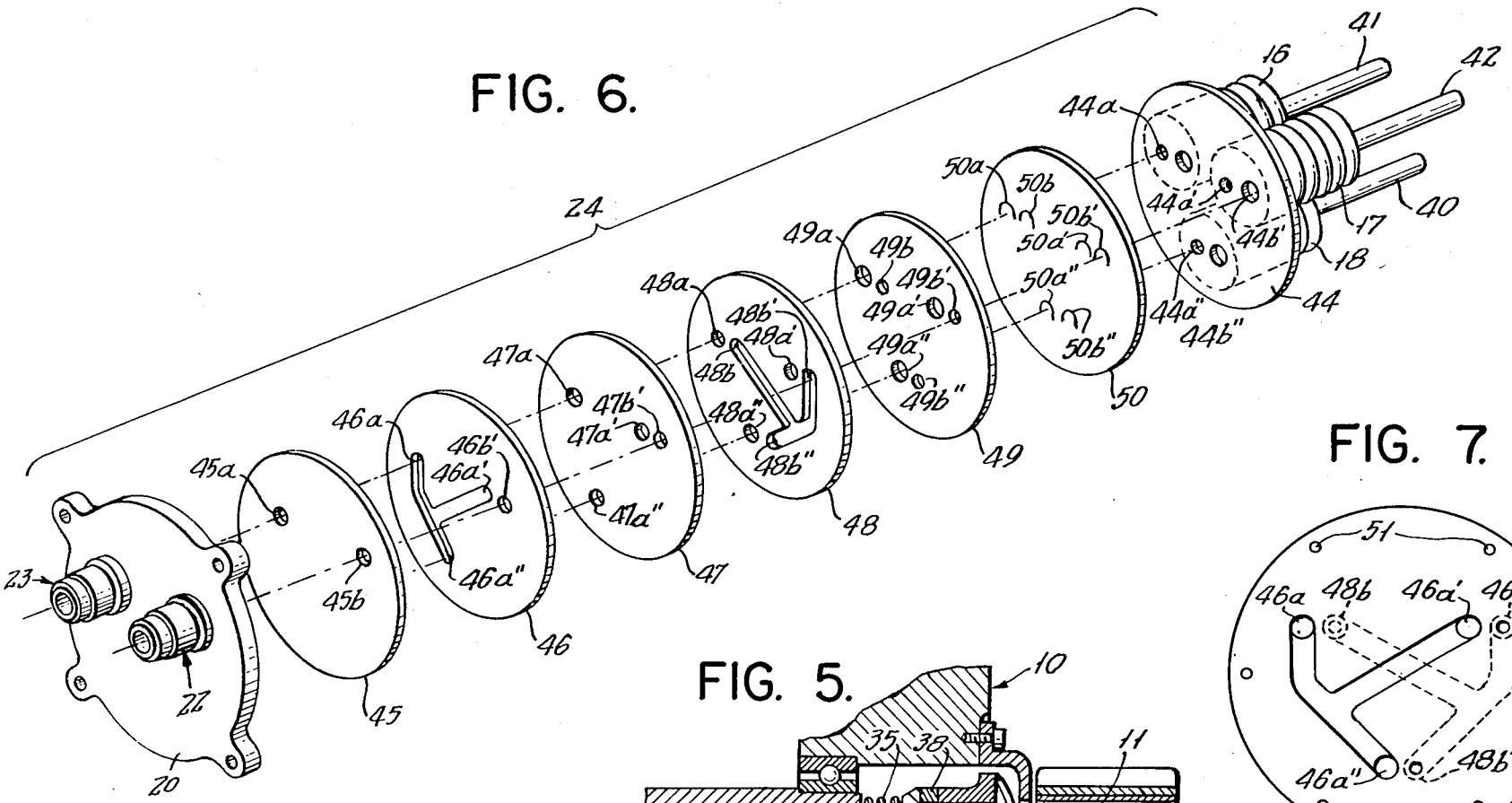
FIG. 6 is an exploded isometric view of components of a valve/manifold unit in the pump of FIGS. 1 and 2.

In FIGS. 1 and 2, an air-pump system of the invention is seen to comprise three unitary subassemblies A, B and C, in fully assembled relation. The subassembly A is contained within a generally cup-shaped housing 10, the closed end of which provides bearing support for an externally driven quill shaft or first spindle part 11, as well as for one end of a second spindle part or pump-drive shaft 12 (FIG. 3). The subassembly B is also contained within a generally cup-shaped housing 13, the closed end 14 of which is bolted at 15 to the housing 10; the closed end 14 provides bearing support for shaft 12, as well as stem guidance, at E, F, G (see FIG. 4), for each of three angularly spaced bellows components 16, 17, 18 (FIGS. 3 and 6). The subassembly C is an air-processing unit based on end-closure plate 20 which is bolted at 21 to the housing 13 and exposes air-inlet and air-outlet port connections 22, 23; the plate 20 is the outer one of a stacked plurality of valve/manifold laminations 24 to which the three bellows components 16, 17, 18 are mounted. The closed end of the A housing 10 is a generally square base 25 having holes 26 at its corners, for mounting the fully assembled pump to bracket or bulkhead structure (not shown), with provision for selective removal of subassembly C, or of the subassemblies B and C, as for periodic inspection and/or servicing.

More particulary, the mechanism of subassembly A is devoted to translating driven rotation of quill 11 and shaft 12 into nutating gyration of an annular swashplate disc 27, which is inclined at an angle $\alpha$ to a normal to the rotary axis. To this end, disc 27 is mounted by a first antifriction thrust bearing 28 to the inclined end of a cam ring 30; ring 30 has a central bore with opposed keyways (engaged to a drive pin 31), for a degree of axially floating guidance on quill 12. Spaced front and back antifriction bearings 32, 33 are mounted to counterbores in the respective hubs of the closed ends 14, 25 of housings 13 and 10, and thrust reaction of the cam ring 30 is directly taken by the end wall or mounting base 25, via an antifriction bearing 34. Quill 11 has splined connection to shaft 12, and a compression spring 35 referenced to shaft 12 continuously loads quill 11 and a radial flange 36 thereof into circumferential continuous wiping contact with seal structure 37, via a low-friction seal ring 38; ring 38 may be of carbon, sandwiched between hardened steel radial faces of flange 36 and structure 37.

As best seen in FIG. 3, the driven end of bellows 18 carries a stem or push rod 40 having preferably antifriction axial guidance in a bushing or linear-bearing unit 39 mounted to a counterbore at radial offset from the rotary axis of quill 12; the projecting end of stem 40 is conical for matching contact with the swashplate disc 27. Bellows 18 will be understood to be of suitably compliant metal, such as stainless steel and to have such a range of axial compressibility as to be axially compliantly loaded via its stem 40 and against disc 27 at all times in the nutation cycle of disc 27. And what has been said as to bellows 18 and its stem will be understood equally to apply to the other two bellows 16, 17 and their respective stems 41, 42 which are concurrently in resilient engagement with disc 27, but at equally phased offset in their tracking of the nutation cycle of disc 27.

As best seen in FIG. 6, the valve/manifold portion 24 of subassembly C comprises, between rigid end plates 20, 44, an aligned succession of laminations 45, 46, 47, 48, 49, 50 which cooperatively serve inlet and outlet air-intake to and air-expulsion from all three of the bellows 16, 17, 18, in the course of each nutation cycle of the swashplate disc 27. To this end, the plate 44, to which the frame-referenced ends of all three bellows 16, 17, 18 are mounted, is provided with a smaller outlet hole and a larger inlet hole for each of the three bellows; for simplified discussion, the outlet and inlet holes serving bellows 16 are designated 44*a* and 44*b*, respectively, while the corresponding holes serving bellows 17 and bellows 18 are respectively designated 44*a*', 44*b*' and 44*a*'', 44*b*''.

In each of the laminations 45 through 50, registering openings 45*a*, 46*a*, 47*a*, 48*a*, 49*a* and 50*a* align the outlet opening 44*a* (for bellows 16) with the outlet port connection 23, except that lamination 50 is flexible, suitably of Mylar, and its opening 50*a* is a U-shaped reed or flap, serving a check-valve function to be later explained. Another exception is lamination 46, wherein the opening is a generally T-shaped manifolding slot wherein 46*a* is on the arm which registers with outlet port connection 23; a second arm 46*a*' of this manifolding slot has registration with openings 47*a*', 48*a*', 49*a*' and 50*a*' which align with the outlet opening 44*a*' for bellows 17; and the third arm 46*a*'' of this manifolding slot has registration with openings 47*a*'', 48*a*'', 49*a*'' and 50*a*'' which align with the outlet opening 44*a*'' for bellows 18. Again, the openings 50*a*' and 50*a*'' in flexible lamination 50 are U-shaped reeds or flaps, for check-valve purposes to be later explained.

In similar fashion, the lamination 48 serves an inlet-air manifolding function in coaction with its adjacent lamination 47, 49. Thus, aligned openings 45*b*', 46*b*', 47*b*', 48*b*',49*b*' and 50*b*' in the respective laminations align the inlet port connection 22 with the inlet opening 44*b*' to bellows 17. This alignment includes one arm 48*b*' of the manifolding T-slot formation of lamination 48; a second arm 48*b* of this T-slot formation aligns with the inlet opening 44*b* to bellows 16 and with further openings 49*b* and 50*b* in the intervening laminations 49, 50; and a third arm 48*b*'' of this T-slot formation aligns with the inlet opening 44*b*'' to bellows 18 and with further inlet openings 49*b*'' and 50*b*'' in the intervening laminations 49, 50. Again, all inlet openings 50*b*, 50*b*' and 50*b*'' in the flexible lamination 50 are U-shaped reeds or flaps for check-valve purposes.

The check valve functions thus far alluded to are realized for inlet-air purposes by sizing the reeds or flaps 50*b*, 50*b*', 50*b*'' so as to flexibly deflect into the larger inlet-air openings of the adjacent rigid lamination 44 which carries all three bellows; the sizing of these inlet flaps is also such in relation to smaller inlet-air openings 49*b*, 49*b*', 49*b*'' in the other adjacent rigid lamination 49, whereby the flaps 50*b*, 50*b*', 50*b*'' will all seat against lamination 49, thereby closing openings 49*b*, 49*b*', 49*b*'' against reverse flow of air to the inlet-port connection 22. In similar but oppositely directed manner, the flaps 50*a*, 50*a*', 50*a*'' function to deflect into the larger openings 49*a*, 49*a*', 49*a*'' of the rigid adjacent lamination 49, thus freely granting passage for pressurized air expelled from the three bellows 16, 17, 18, and manifolded at 46 to the single outlet-port connection 23; also, the sizing of flaps 50*a*, 50*a*', 50*a*'' with respect to the smaller openings 44*a*, 44*a*', 44*a*'' results in the seating of these flaps against plate 44 so as to foreclose any inlet-air function with respect to the outlet-port connection 23.

Figure 7:
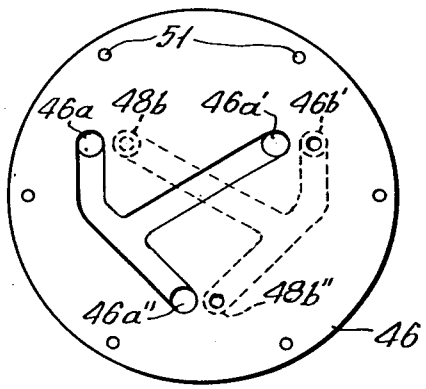
FIG. 7 is a plan view of a first manifold element in relation to a second manifold element, in the valve/-manifold unit of FIG. 6.
Figure 5:
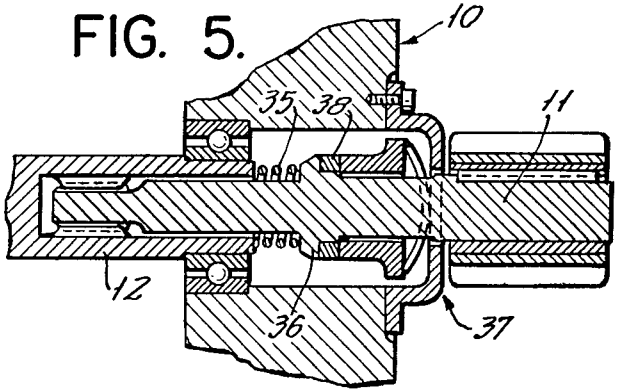
FIG. 5 is an enlarged fragmentary view in longitudinal section to show detail of a mechanical seal which is only generally shown in FIG. 3.

The described valve/manifold stack 24 may be a relatively thin consolidated assembly, retained by tie bolts (not shown) between end plates 20, 44, as suggested by a succession of tie-bolt openings 51 in the lamination 46 of FIG. 7. And it will be appreciated that in the course of each nutating cycle of the swash-plate disc 27, the axially compliant preload of stems 40, 41, 42 against disc 27 assure correctly phased sequencing of all inlet-valve and outlet-valve functions of the reeds or flaps of lamination 50, so that a smoothly manifolded inlet-air flow at 22 and outlet-air flow at 23 is the necessary consequence. It will be further appreciated that this consequence is achieved via no contaminating exposure of the involved air to any lubricated part or to any part which could possibly be affected by such minimal lubrication as might be deemed desirable for the mechanical bearing and seal components of the pump system. Incidentally, although the structure and function of parts and relationships at 35, 36, 37, 38 has been said to be one of sealing, the involved seal has nothing to do with and in no sense contacts the inlet and outlet flow of pumped air; the "seal" action at 35, 36, 37, 38 is merely such as to keep dust and other possible foreign matter out of the internal mechanism, (and to provide a measure of dynamic articulated adaptation to drive motor and coupling means not shown), thus extending its potential for a long and troublefree life.

In the preferred embodiment, the shaft bearings 32, 33 are deep-groove ball bearings, in opposed angular-contact relation; the thrust bearings 28, 34 are also deep-groove ball bearings; and the linear bearings at 39 for each of the reciprocating stems 40, 41, 42 are so-called super-precision linear ball bearings, such as are available in the Series LP of Barden.

The described invention will be seen to achieve all stated objectives. The preferred three-bellows arrangement reduces output air pulsations to a minimum and compliantly balances the swashplate. Each bellows preferably consists of a laminated multi-convoluted element having a consistent laminated wall thickness in the order of 0.005 inch, and the stem-connected end of each bellows is a stainless-steel plate which is electron-beam welded to the laminated bellows. The laminations 45 to 49 may be of aluminum but are preferably of corrosion-resistant steel. And it is inherent in the construction that the airstream cannot be contaminated with any metallic or other wear particles.

While the invention has been described in detail for a preferred embodiment, it will be understood that modifications can be made without departure from the scope of the invention.

What is claimed is:

1. In a multiple-bellows air compressor comprising a frame, a swash plate mounted to said frame for cyclic rotary oscillation of its tilted inclination with respect to a central axis of continuous rotary drive, plural like bellows devices angularly spaced about said central axis and mounted with one end fixedly referenced to said frame and the other end in actuable engagement with said swash plate, said bellows devices being axially compliant and in compliantly loaded tracking relationship with corresponding angularly spaced parts of said swash plate, inlet check-valve means associated with the fixed end of each bellows device, and outlet check-valve means associated with the fixed end of each bellows device, the improvement wherein all said check-valve means are contained within a consolidated stack of laminations having a single inlet-port connection and a single outlet-port connection at one end and mounting said plural bellows devices at the other end, said stack including first laminations for manifolding said single inlet-port connection to each of said bellows devices, second laminations for manifolding said single outlet-port connection to each of said bellows devices, and third laiminations including a flexible lamination having individual deflectable check-valve formations therein.

2. The air compressor of claim 1, in which said check valves are reed-type valves.

3. The air compressor of claim 1, in which the number of bellows devices is three.

4. The air compressor of claim 1, in which all deflectable inlet and all outlet check-valve formations are in a single flexible lamination.

5. The air compressor of claim 1, in which said frame comprises a first cup-shaped housing open at one end and having at its other end a closure wall with bearing support for one end of a central drive shaft which mounts said swash plate within said first housing, a second cup-shaped housing open at one end and having at its other end a closure wall with bearing support for the other end of said drive shaft, said end wall having a plurality of longitudinal guide bores at equal angular spacing and at a single radius of swash-plate offset from the drive shaft, and a housing-closure member for the open end of said second cup-shaped member, said members being removably secured to each other, and a plurality of like compliant bellows devices carried by said housing-closure member within said second housing member and in compliantly loaded relation to said swash plate via push rods in the respective guide bores.

6. The air compressor of claim 5, in which said consolidated stack of multiple laminations is carried by said housing-closure member and is interposed between said housing-closure member and said bellows devices.

7. The air compressor of claim 1, in which, for each bellows device, a push rod is interposed between said other end and said swash plate, said push rods being frame-guided on axes of longitudinal oscillation which are at equal angular spacing and at one and the same radial offset from said central axis.

8. The air compressor of claim 7, in which linear antifriction bearing means provides the frame guidance of each push rod.

9. The air compressor of claim 1, in which said swash plate is annular and is mounted by antifriction thrust-bearing means to an annular cam member, said cam member being mounted for continuous rotation and mounting said antifriction thrust-bearing means in an end plane that is inclined with respect to the rotary axis of said cam member.

10. The air compressor of claim 9, in which further antifriction thrust-bearing means centered on said central axis is interposed between said cam member and said frame, thereby establishing a frame to swash-plate thrust-reaction force.

11. The air compressor of claim 10, in which the radial locus of each of said thrust-bearing means is substantially the same as the radial locus of swash plate thrust-actuation of said bellows devices.

* * * * *